US008899879B2

(12) United States Patent
Foo et al.

(10) Patent No.: US 8,899,879 B2
(45) Date of Patent: Dec. 2, 2014

(54) STRUCTURE-SUPPORTED JACKUP SYSTEM

(71) Applicant: Keppel Offshore & Marine Technology Centre Pte Ltd, Singapore (SG)

(72) Inventors: Kok Seng Foo, Singapore (SG); Michael John Perry, Singapore (SG); Matthew Chin Kau Quah, Singapore (SG); Cynthia Wang, Singapore (SG); Tak On Cheung, Houston, TX (US); Randall Scott Shafer, Houston, TX (US); Peter Noble, Houston, TX (US)

(73) Assignee: Keppel Offshore & Marine Technology Centre Pte Ltd, Singapore (SG)

( * ) Notice: Subject to any disclaimer, the term of this patent is extended or adjusted under 35 U.S.C. 154(b) by 0 days.

(21) Appl. No.: 13/751,153

(22) Filed: Jan. 28, 2013

(65) Prior Publication Data

US 2014/0147214 A1 May 29, 2014

(30) Foreign Application Priority Data

Nov. 23, 2012 (SG) ..... 201208667-4

(51) Int. Cl.
*E02B 17/08* (2006.01)

(52) U.S. Cl.
CPC ..... *E02B 17/08* (2013.01)
USPC ..... 405/196; 405/203

(58) Field of Classification Search
USPC ..... 405/196, 201, 203, 204, 205, 209
See application file for complete search history.

(56) References Cited

U.S. PATENT DOCUMENTS

| | | | | |
|---|---|---|---|---|
| 4,451,174 | A | 5/1984 | Wetmore | |
| 4,478,537 | A * | 10/1984 | Birdy et al. | 405/217 |
| 5,219,451 | A * | 6/1993 | Datta et al. | 405/204 |
| 5,290,128 | A * | 3/1994 | Yeargain et al. | 405/209 |
| 6,027,287 | A * | 2/2000 | Faldini | 405/209 |
| 6,293,734 | B1 * | 9/2001 | Thomas et al. | 405/209 |
| 6,347,909 | B1 * | 2/2002 | Kocaman | 405/209 |
| 7,410,326 | B2 * | 8/2008 | Morrison et al. | 405/201 |
| 7,513,713 | B2 * | 4/2009 | Thomas et al. | 405/203 |
| 7,886,845 | B2 * | 2/2011 | King et al. | 175/40 |
| 8,070,388 | B2 * | 12/2011 | Thomas | 405/203 |
| 2004/0151549 | A1 * | 8/2004 | Roodenburg et al. | 405/201 |
| 2004/0218983 | A1 * | 11/2004 | Roraas et al. | 405/204 |
| 2004/0253060 | A1 * | 12/2004 | Horton, III | 405/205 |
| 2005/0013667 | A1 * | 1/2005 | Thomas | 405/209 |

(Continued)

FOREIGN PATENT DOCUMENTS

| | | |
|---|---|---|
| FR | 2669952 A1 | 6/1992 |
| RU | 2036268 C1 | 5/1995 |

OTHER PUBLICATIONS

International Search Report of international patent application No. PCT/SG2013/000498 completed on Feb. 11, 2014 and mailed on the same day ( 4 pages ).

(Continued)

*Primary Examiner* — Benjamin Fiorello
(74) *Attorney, Agent, or Firm* — Pyprus Pte Ltd

(57) ABSTRACT

A structure-supported Jackup system comprising a Jackup drilling unit with a main deck structure and a plurality of legs movably coupled with the main deck structure, two or more support base structures disposed on seabed, and a plurality of movable supports, wherein each of the plurality of movable supports is securely coupled with either the main deck structure or one of the two or more support base structure.

8 Claims, 7 Drawing Sheets

(56) References Cited

U.S. PATENT DOCUMENTS

| | | | | |
|---|---|---|---|---|
| 2005/0158125 | A1* | 7/2005 | Thomas et al. | 405/203 |
| 2009/0208294 | A1* | 8/2009 | Yao et al. | 405/196 |
| 2009/0324342 | A1* | 12/2009 | Thomas et al. | 405/209 |
| 2010/0221069 | A1* | 9/2010 | Brinkmann et al. | 405/203 |
| 2011/0142590 | A1* | 6/2011 | Chow et al. | 414/800 |
| 2012/0247830 | A1 | 10/2012 | Advocaat et al. | |
| 2013/0004242 | A1* | 1/2013 | Roper | 405/196 |
| 2013/0101357 | A1* | 4/2013 | Noble et al. | 405/196 |

OTHER PUBLICATIONS

Written Opinion of international patent application No. PCT/SG2013/000498 dated Feb. 11, 2014 ( 4 pages).

* cited by examiner

STRUCTURE-SUPPORTED JACKUP SYSTEM

FIELD OF THE INVENTION

The present invention relates generally to jackup systems for offshore deployment, and more particularly to a structure-supported jackup system suitable for drilling and/or production at offshore locations subject to sea ice.

BACKGROUND OF THE INVENTION

A Jackup system is widely used in offshore exploration for drilling wells and gas/oil production. With the increase of demand of energy, the offshore exploration is moving more and more toward the locations where sea ice or other hazards are present. Therefore, the operability range of a Jackup system is critical for its performance.

The existing options for offshore exploration using current Jackup systems include:

1. Drilling exploration wells from a "normal" Jackup system during ice free season with the riser unprotected;
2. Drilling production wells through a fixed production facility using a "normal" Jackup system during ice free season; and
3. Drilling from a large dedicated drilling platform or combined drilling and production platform designed to resist ice loads all year round.

However, the limitation of exploration to ice free season is not desirable. In addition, the large dedicated drilling platform or combined drilling and production platform designed to resist ice loads is a permanent structure that cannot be easily removed for reuse when the drilling activity is complete. Furthermore, it may not be economical for exploration drilling where only a small number of wells are drilled at a location.

SUMMARY OF THE INVENTION

One objective of this invention is to provide a structure-supported Jackup system suitable for chilling and/or production at offshore locations subject to sea ice. The structure-supported system is designed for operation in shallow water up to about 100 m, allowing for the drilling of exploration or production wells using a Jackup drilling unit. Furthermore, the structure-supported Jackup system is easily removable for reuse once the required wells have been drilled, serving as a cost effective solution for providing production facilities at marginal locations where the cost of development of a dedicated platform may be prohibitive.

One aspect of the present invention provides a structure-supported Jackup system. In one embodiment, the structure-supported Jackup system comprises a main deck structure, a plurality of legs movably coupled with the main deck structure, a cantilever disposed upon the main deck structure, a derrick disposed upon the cantilever; wherein the main deck structure, the plurality of legs, the cantilever and the derrick form a Jackup drilling unit, two or more support base structures disposed on seabed, and a plurality of movable supports, wherein each of the plurality of movable supports is securely coupled with either the main deck structure or one of the two or more support base structure; so that during the process of the structure-supported Jackup system is being assembled, the plurality of movable supports is being moved to a position between the main deck structure and the two or more support base structures while the plurality of legs provide support for the Jackup drilling unit, and when the structure-supported Jackup system is assembled, the two or more support base structures provide support for the Jackup drilling unit via the movable supports, and the plurality of legs are retracted into a position out of water.

In another embodiment of the structure-supported Jackup system, the support base structure is an ice resistant structure. In a further embodiment of the structure-supported Jackup system, the ice resistant structure is a caisson.

In another embodiment of the structure-supported Jackup system, the movable supports are securely coupled to the support base structure. In yet another embodiment of the structure-supported Jackup system, the movable supports are securely coupled to the main deck structure and extend from the main deck structure to the top of the support base structure.

In another embodiment of the structure-supported Jackup system, the support base structure may be interconnected to form a single support base structure.

Another aspect of the present invention provides a process for assembling a structure-supported Jackup system. In one embodiment, the process comprises providing two or more support base structures disposed on seabed, wherein the two or more support base structures are aligned in two sides; moving a Jackup drilling unit into a position between the two sides of the two or more support base structures, wherein the Jackup drilling unit comprises a main deck structure; a plurality of legs movably coupled with the main deck structure; a cantilever disposed upon the main deck structure; and a derrick disposed upon the cantilever; lowering the plurality of legs into the seabed; lifting the Jackup drilling unit out of the water using the plurality of legs; providing a movable support between the support base structure and the main deck so that the movable support provides support to the Jackup drilling unit; and retracting the plurality of legs out of water.

The objectives and advantages of the invention will become apparent from the following detailed description of preferred embodiments thereof in connection with the accompanying drawings.

BRIEF DESCRIPTION OF THE DRAWINGS

Preferred embodiments according to the present invention will now be described with reference to the Figures, in which like reference numerals denote like elements.

DETAILED DESCRIPTION OF THE INVENTION

Figure 1:
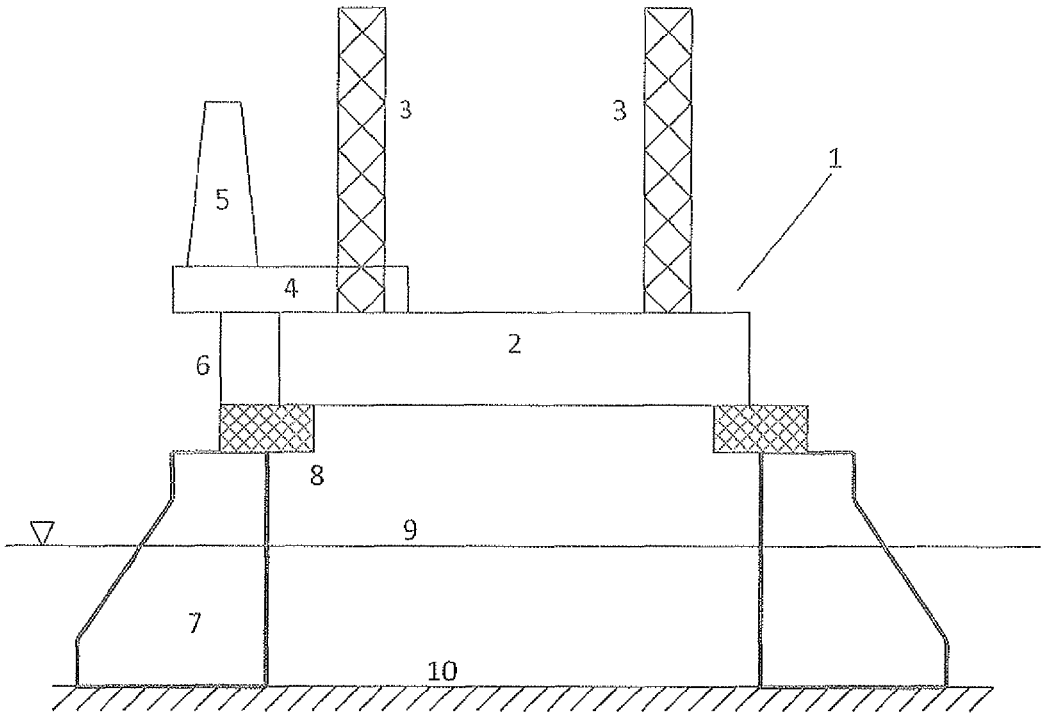
FIG. 1 is a block diagram illustrating an assembled structure-supported Jackup system in accordance with one embodiment of the present invention.

The present invention may be understood more readily by reference to the following detailed description of certain embodiments of the invention.

Throughout this application, where publications are referenced, the disclosures of these publications arc hereby incorporated by reference, in their entireties, into this application in order to more fully describe the state of art to which this invention pertains.

One aspect of the present invention provides a structure-supported Jackup system suitable for offshore deployment in locations subject to sea ice. Briefly, the structure-supported Jackup system comprises a Jackup unit and two or more support base structures for providing the support to the Jackup unit so that the Jackup unit is out of the water; when the structure-supported Jackup system is assembled, no leg is in the water so as to eliminate any hazard caused by sea ice to the legs. The support base structure is preferably a steel or concrete caisson supported on the seabed by gravity, piles or suction. Caisson will be used as the exemplary support base structure in the drawings and respective descriptions. However it is to be understood that the support base structure could be others including piled monopods or gravity base structures. The support base structure may additionally serve other purposes such as being a production platform or wellhead platform.

For a typical Jackup system, the leg to leg spacing is in range of 40 m to 70 m, and the overall hull size is of 60 m to 90 m. For an exemplary three legged Jackup system, the caisson would therefore need to provide supports over one side (probably the stern) over a distance of at least 40 m or more and additional support at the bow. That is, it would be expected that the supports should be provided at least at locations close to each of the Jackup legs as these will represent the most likely strong points. Based on this, it is likely that the number of supports will be at least as many as the number of legs. In a preferred embodiment, a long caisson structure supports the aft end of the Jackup and a similar or smaller caisson supports the bow. In shallow water of say 25 m, these caissons may have example dimension of 60 m long by 25 m wide at the base and 35 m high. In deeper water it is likely that the width, and of course height, would increase. The probable airgap (distance from the water level to the bottom of the hull) in the installed condition would be approximately 10 m to 20 m. The specific Ice conditions where the structure supported Jackup system would be most likely to be used would be on sites subject mainly to level ice of thickness 0.5 m to 3 m and with possible occurrence of thicker rafted or ridged ice features. The water depth would preferably be 5 to 70 m.

Referring now to FIG. 1, there is provided a block diagram illustrating an assembled structure-supported Jackup system in accordance with one embodiment of the present invention. The assembled. structure-supported Jackup system 1 comprises a main deck structure 2, a plurality of legs 3, a cantilever structure 4, a derrick 5, a drilling riser 6, two or more support base structures (caisson) 7, and a plurality of movable supports 8. The main deck structure 2, the plurality of legs 3, the cantilever structure 4, the derrick 5, and the drilling riser 6 are well known in the art, forming a Jackup drilling unit, where the main deck structure 2 provides support for the cantilever structure 4 which in turn supports the derrick 5, the drilling riser 6 enables the derrick 5 to do the drilling, and the plurality of legs 3 are movably coupled with the main deck structure so as to provide the support during the assembly. The two or more support base structures 7 are disposed onto the seabed 10, and the plurality of movable supports 8 are so disposed between the support base structure 7 and the main deck structure 2 that the support base structure 7 provides support to the main deck structure 2. Once the structure-supported Jackup system is assembled will the main deck structure 2 be above the water line 9 with the legs 3 fully retracted out of the water.

Figure 2:
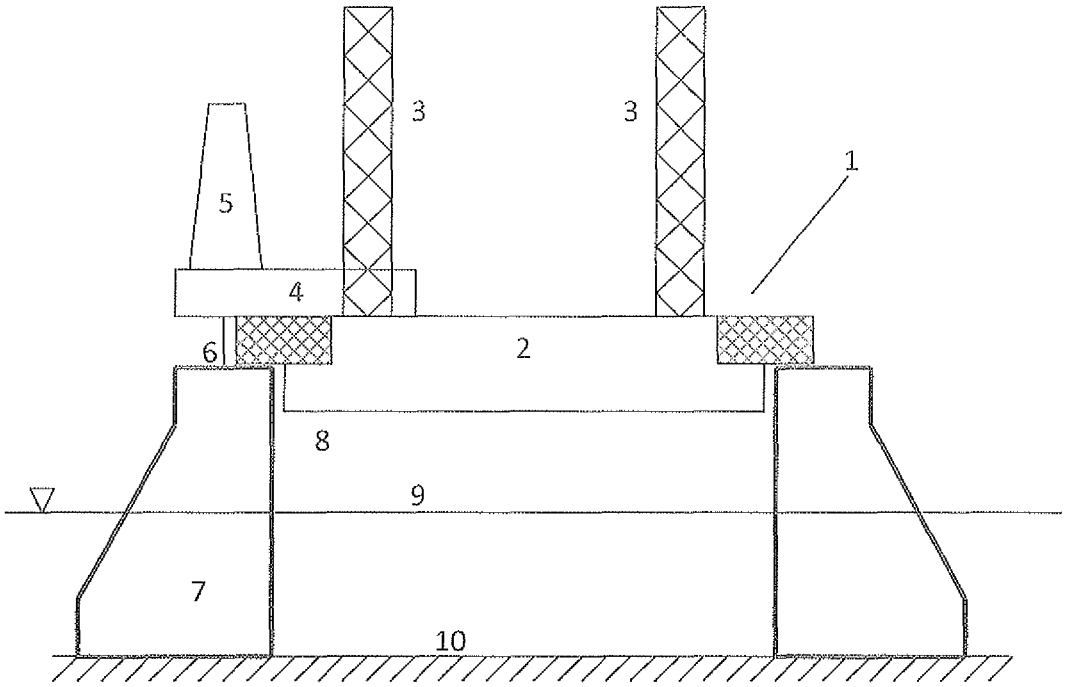
FIG. 2 is a block diagram illustrating an assembled structure-supported Jackup system in accordance with one embodiment of the present invention.

As shown in FIG. 1, the movable supports 8 are securely coupled to the support base structure (caisson) 7, and skid from a location near the top of the caisson to support the main deck structure 2 from below. As shown in FIG. 2, the movable supports 8 are securely coupled to the main deck structure 2 and extend from the main deck structure 2 to the top of the caisson. The advantage of this is that the mechanical systems needed to move the movable supports 8 into position are housed on the main deck structure 2 and can therefore be reused at different locations. The movable supports would require vertical dimension in the order of several meters and would be movable to extend beyond the edge of the caisson (if supported on the caisson, or edge of the Jackup if supported on jackup.

Figure 3:
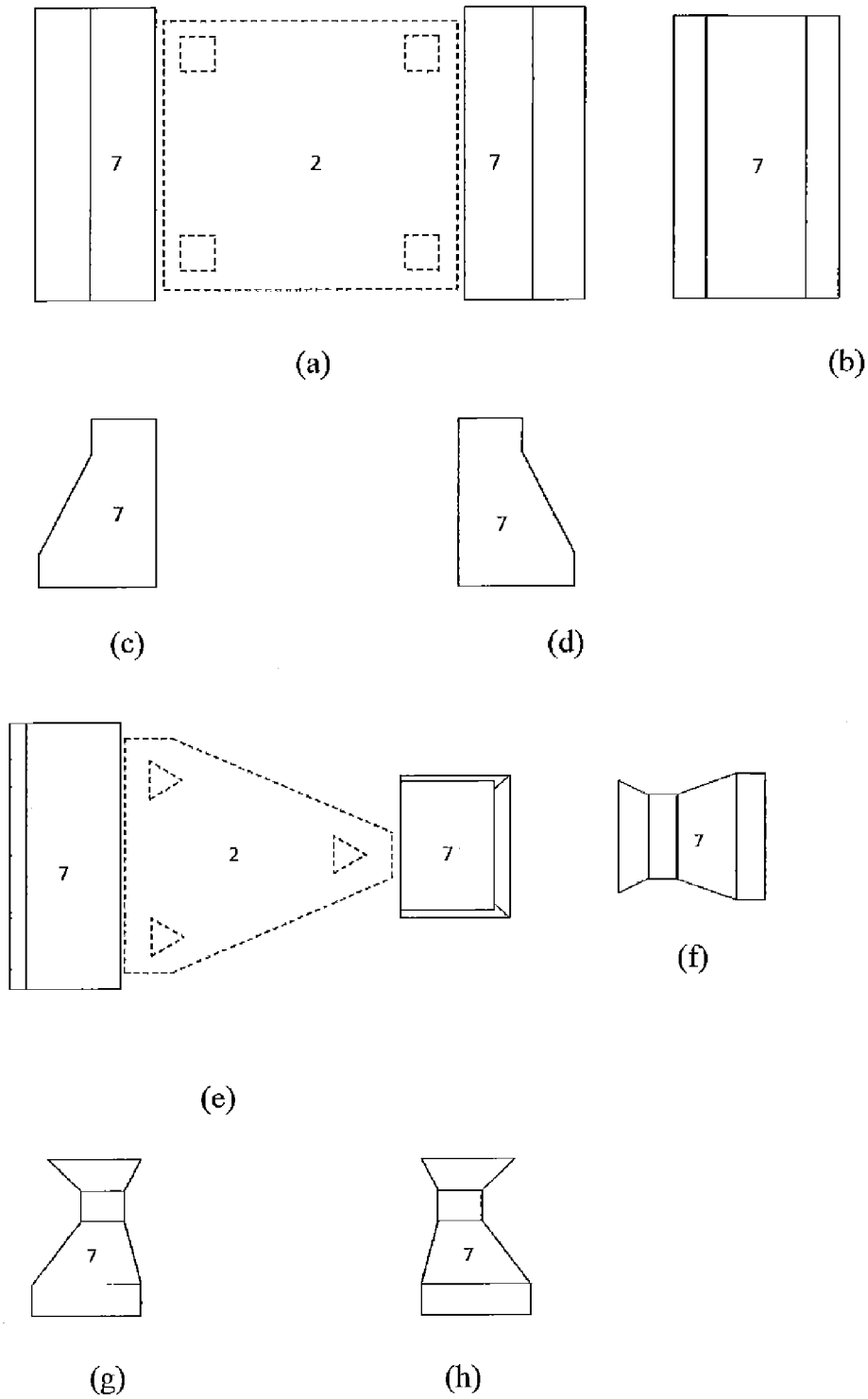
FIG. 3 shows exemplary configurations of the support base structure.

Referring now to FIG. 3(*a-h*), there is provided exemplary configurations of the support base structure and arrangements in the structure supported Jackup system. The configuration of the support base structures can be designed in order to improve the resistance to ice by providing sloped or conical profiles. The arrangements in the structure supported Jackup system could vary according to the Jackup design as well as the site water depth and environment. FIG. 3(*a-d*) shows a rectangular, four leg Jackup, where two long support base structures are used to support two of the sides of the Jackup. The sides of the support base structures are sloped so as to reduce ice loads on the outer faces. FIG. 3(*e-h*) shows a triangular, three-leg Jackup, where a smaller support base structure may be preferred at the forward leg. The support base structure shown in the second example is sloped on all sides to further reduce loads coming from other directions. It is to be understood that many possible support arrangements may be suitable for providing the required support. It is also possible that the support base structures could be interconnected to form a single integrated support base structure, for example by connecting along a side or at a position and depth sufficient so as not to cause interference during installation. The configuration, arrangement and number of supporting base structures would be selected based on the characteristics of the site.

Figure 4:
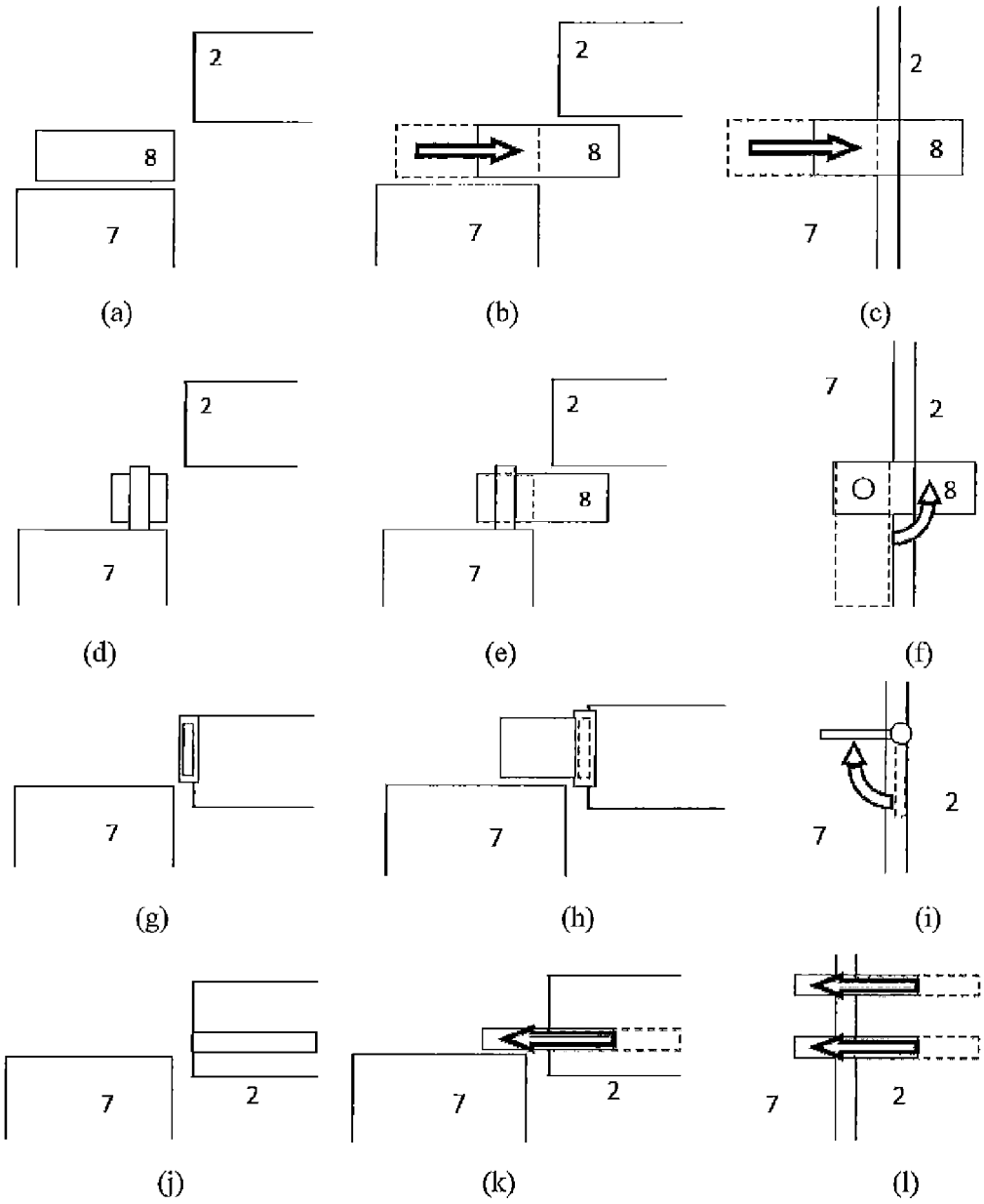
FIG. 4 shows exemplary coupling mechanisms of coupling the movable supports to the support base structures or main deck structures.

Referring now to FIG. 4(*a-l*), there is provided exemplary coupling mechanisms by which the movable supports 8 are so coupled with the support base structure 7 or main deck structure 2 that the movable supports 8 are being moved into positions by sliding, rotating, hinged or pinned mechanisms. As shown in FIG. 4(*a-c*), the coupling mechanism is provided on the support base structure (caisson) and the coupled movable support is skidded out in order to support the Jackup in a similar way to the skidding of a Jackup drilling cantilever. As shown in FIG. 4(*d-f*), the coupling mechanism is provided as a rotatable connector pivoted on the support base structure and the movable support is coupled with the rotatable connector in such a way that it may be rotated into position to provide support. As shown in FIG. 4(*g-i*), the coupling mechanism is provided at the side of the main deck structure, whereby the movable support is coupled to the main deck structure, folded alongside the main deck structure when not in use and is rotatable over the support base structure (caisson) in order to provide support. As shown in FIG. 4(*j-l*), the coupling mechanism is provided as the receptive chambers and the movable supports are movably coupled with the receptive chambers so that they may be skidded out over the top of the support base structure to provide support for the Jackup unit. The required hold down mechanisms and details are excluded from these figures for clarity of the concept. Other types of coupling mechanisms not shown here could also be used to achieve the desired support. For example, the sliding mechanism in FIG. 4(*a-c*) could be modified to provide pins that support the main deck structure by engaging openings in the side of the main deck structure rather than supporting it from beneath.

Referring now to FIGS. 5A-5E, there is provided an exemplary sequence of assembling of the structure-supported Jackup system shown in FIG. 1. However it would also be possible to assemble the structure-supported Jackup system in other ways depending on the final support configuration.

Figure 5A:
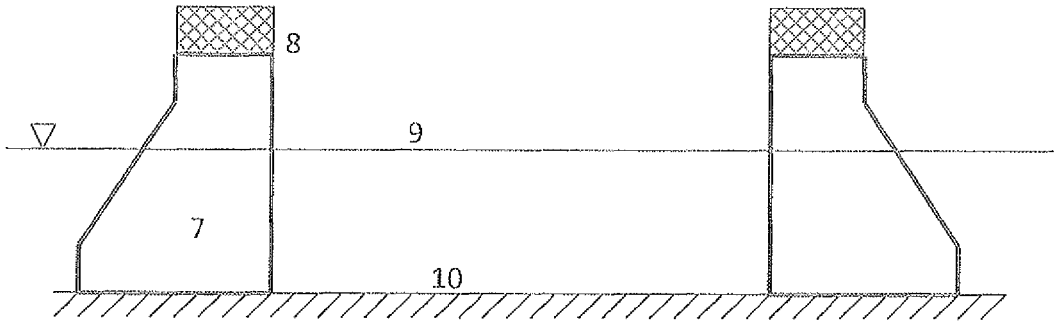
FIGS. 5A-5E show an exemplary sequence of assembling of the structure-supported Jackup system shown in FIG. 1.

As shown in FIG. 5A, the support base structures 7 are installed in the correct position ready to receive the Jackup drilling unit, where the moveable supports 8 are provided on the top of the support base structures in a retracted position.

Figure 5B:
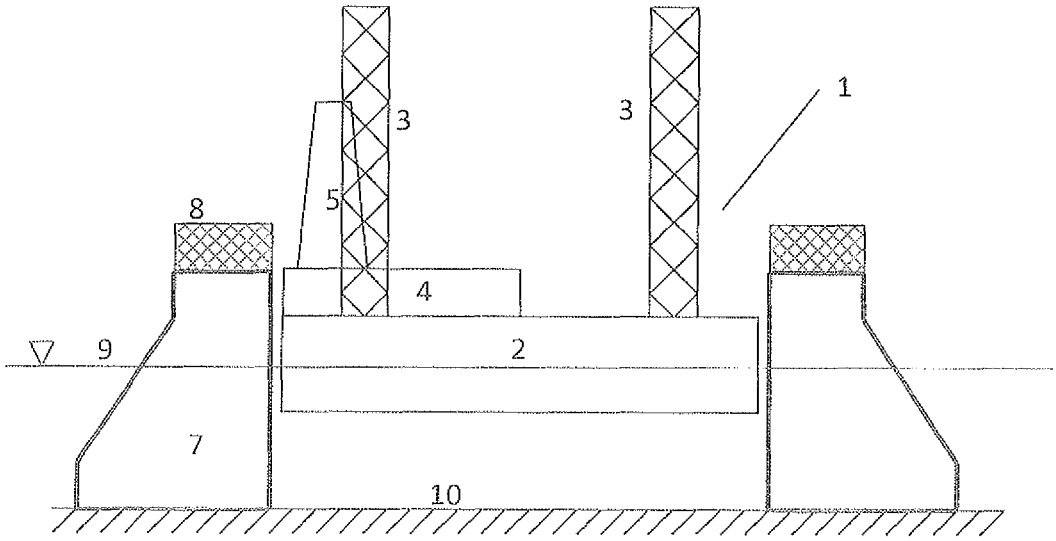

As shown in FIG. 5B, the Jackup drilling unit is being floated into the position between the support base structures 7, where the legs 3 are elevated, and the main deck structure 2 is buoyant allowing the Jackup drilling unit to self float. However it is to be understood that the main deck structure may also be supported, for example, on a barge.

Figure 5C:
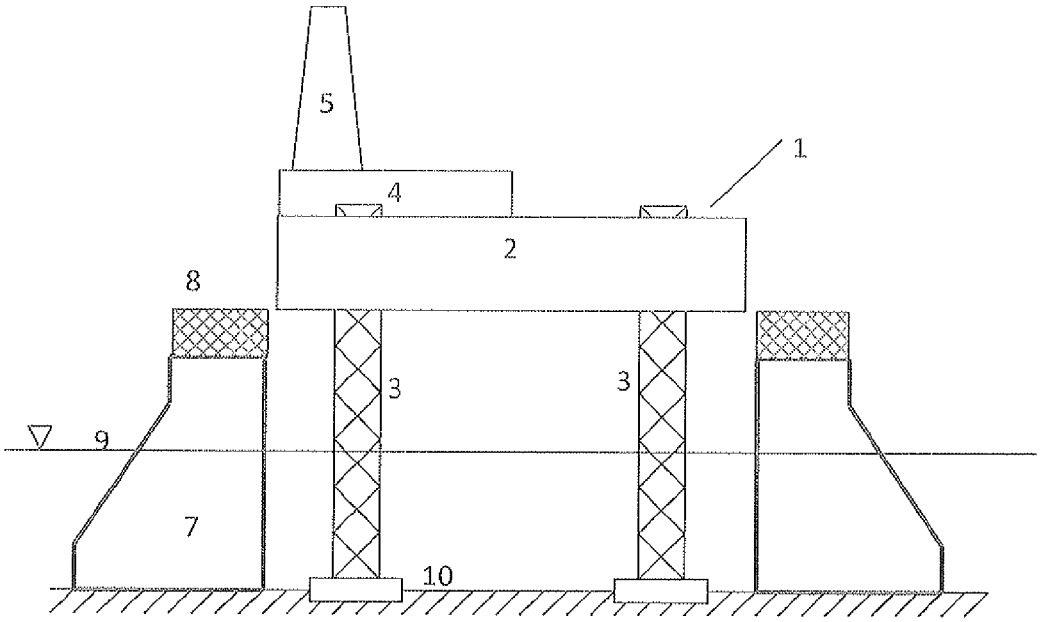

As shown in FIG. 5C, the main deck structure 2 along with supported components is elevated above the support base structures 7 by lowering the legs 3 to the seabed and then lifting the main deck structure to the required elevation using the jackups jacking system.

Figure 5D:
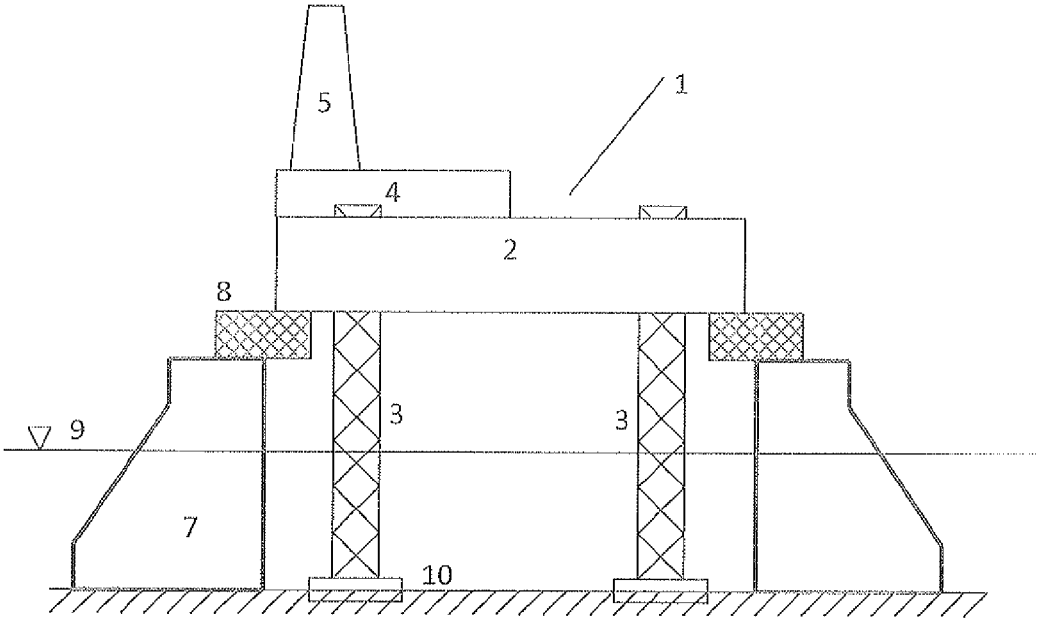

As shown in FIG. 5D, the moveable supports 8 are being moved into the position beneath the main deck structure 2 and secured in place, where the main deck structure is lowered slightly in order to transfer the load to the movable supports.

Figure 5E:
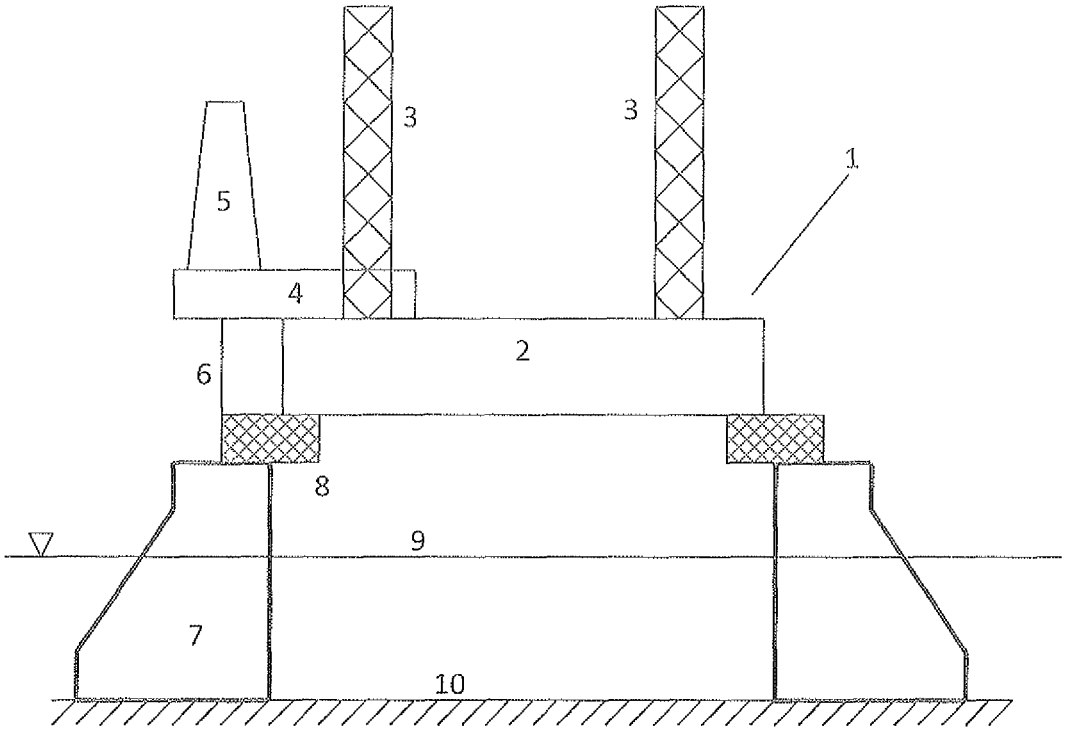

As shown in FIG. 5E, the legs 3 are finally elevated and the cantilever (4) skidded out to complete the assembly.

The removal of the Jackup drilling unit can proceed in the opposite sequence to that described above.

While the present invention has been described with reference to particular embodiments, it will be understood that the embodiments are illustrative and that the invention scope is not so limited. Alternative embodiments of the present invention will become apparent to those having ordinary skill in the art to which the present invention pertains. Such alternate embodiments are considered to be encompassed within the scope of the present invention. Accordingly, the scope of the present invention is defined by the appended claims and is supported by the foregoing description.

What is claimed is:

1. A structure-supported jackup system, comprising:

a main deck structure;

a plurality of legs movably coupled with the main deck structure;

a cantilever disposed upon the main deck structure;

a derrick disposed upon the cantilever; wherein the main deck structure, the plurality of legs, the cantilever and the derrick form a jackup drilling unit;

two or more support base structures disposed on seabed; and a plurality of movable supports, wherein each of the plurality of movable supports is securely coupled with the main deck structure;

so that during a process of the structure-supported jackup system is being assembled, the plurality of movable supports extend from the main deck structure to top of the two or more support base structures while the plurality of legs provide support for the jackup drilling unit, and after the structure-supported jackup system is assembled, the two or more support base structures provide support for the jackup drilling unit via the movable supports, and the plurality of legs are retracted into a position out of water.

2. The structure-supported jackup system of claim 1, wherein the support base structures are an ice resistant structure.

3. structure-supported jackup system of claim 2, wherein the ice resistant structures are a caisson.

4. The structure-supported jackup system of claim 1, wherein the two or more support base structures are interconnected to form an integrated base structure.

5. A process for assembling a structure-supported jackup system, said process comprising:

providing two or more support base structures disposed on seabed, wherein the two or more support base structures are aligned in two opposite sides;

moving a jackup drilling unit into a position between the two opposite sides of the two or more support base structures, wherein the jackup drilling unit comprises a main deck structure;

a plurality of legs movably coupled with the main deck structure;

a cantilever disposed upon the main deck structure; and a derrick disposed upon the cantilever;

lowering the plurality of legs into the seabed;

lifting the jackup drilling unit out of the water using the plurality of legs;

providing a movable support securely coupled with the main deck structure and extending from the main deck structure to the top of two or more support base structure; and retracting the plurality of legs out of water.

6. The process of claim 5, wherein the support base structures are an ice resistant structure.

7. The process of claim 6, wherein the ice resistant structures are a caisson.

8. The process of claim 5 wherein the support base structures are interconnected to form an integrated base structure.

* * * * *